United States Patent [19]

Nield

[11] Patent Number: 4,906,981

[45] Date of Patent: Mar. 6, 1990

[54] METHOD AND APPARATUS FOR MONITORING THE EFFECTIVE LOAD CARRIED BY A CRANE

[76] Inventor: Barry J. Nield, 1490 Tamarac Street, Kingston, Ontario, Canada, K7M 7J7

[21] Appl. No.: 221,743

[22] Filed: Jul. 20, 1988

[51] Int. Cl.[4] ..... G08B 21/00

[52] U.S. Cl. ..... 340/685; 212/150

[58] Field of Search ..... 340/685; 212/150, 155, 212/261

[56] References Cited

U.S. PATENT DOCUMENTS

| | | | |
|---|---|---|---|
| 3,771,667 | 11/1973 | Becker | 340/685 |
| 3,870,160 | 3/1975 | Hutchings | 340/685 |
| 4,039,084 | 8/1977 | Shinohara | 212/155 |
| 4,185,280 | 1/1980 | Wilhelm | 340/685 |
| 4,216,868 | 8/1980 | Geppert | 340/685 |
| 4,509,376 | 4/1985 | Thomasson | 340/685 |
| 4,752,012 | 6/1988 | Juergens | 212/150 |
| 4,833,615 | 5/1989 | Bitner et al. | 340/685 |

FOREIGN PATENT DOCUMENTS

| | | |
|---|---|---|
| 2144815 | 2/1973 | France . |
| 2346278 | 10/1977 | France . |
| 1182070 | 7/1968 | United Kingdom . |
| 2072343 | 9/1981 | United Kingdom . |

*Primary Examiner*—Glen R. Swann, III

*Attorney, Agent, or Firm*—Stanley G. Ade; Murray E. Thrift; Adrian Battison

[57] ABSTRACT

This is a method and apparatus for monitoring the effective load carried by a crane having a luffing boom of variable effective length. The method includes generating a first signal corresponding to the magnitude of the load supported by the boom and then a second signal corresponding to the effective radius. Calculations are made to calculate a moment value and displaying same. This is then compared with a predetermined maximum permissible moment value and a warning signal is generated it if differs from the maximum load moment value by less than a predetermined amount. The apparatus provides apparatus for carrying out the method by generating a first signal corresponding to the load supported by the boom and a second signal corresponding to the effective radius and includes processing means for performing calculation of the first and second signals to derive the load moment value and displaying same and memory means for storing a predetermined maximum permissible load moment value and comparative means for comparing the calculated load moment value with a predetermined maximum permissible load moment value.

15 Claims, 6 Drawing Sheets

METHOD AND APPARATUS FOR MONITORING THE EFFECTIVE LOAD CARRIED BY A CRANE

BACKGROUND OF THE INVENTION

This invention relates to a method and apparatus for monitoring the effective load carried by a crane having a luffing boom of variable effective length.

Any crane has a maximum load rating which cannot safely be exceeded without instability, damage to the crane or even catastrophic failure. The effective load (or load moment) of the crane depends on the magnitude of the load and the effective radius between the point at which the load is attached to the boom and the boom pivot, measured horizontally.

In the case of a crane with a luffing boom, that is, a boom which can be pivoted through a vertical arc, the effective boom radius will be a function of the boom angle. Clearly, the load moment in a crane with a boom of variable length which is carrying a certain load at the end of a fully extended boom which is parallel to the ground will be greater than the load in the same crane, carrying the same load, when the boom is retracted and/or luffed above the horizontal. Thus, a load which may safely be carried by the crane under certain circumstances may exceed the maximum permissible load moment of the crane under other circumstances.

PRIOR ART

GB No. 2072343 (=EP 35809): M. J. EWERS ET AL/PHILIPS ELECTRONIC AND ASSOCIATED INDUSTRIES LIMITED Discloses a computerized safe load indicating system which involves the calculation of the load moment and includes sensors which produces signals representative of the luffing angle and the boom length. In addition any bending of the beam is taken into account by the system.

GB No. 1182070: J. ERLER/VEB LANDMASCHINENBAU "ROTES BANNER" DOBELN Discloses a crane having a luffing jib and means to detect when the load moment has exceeded a predetermined threshold, when such threshold has been reached either a hydraulic or an electrical circuit is activated to prevent the jib's being moved further towards a position which would result in instability of the crane.

FR No. 2346278 (=ED 2650442): H.C. NGUYEN/-SOCIETE ANONYME FRANCAISE DU FERODO Discloses a method of determining the load moment for a crane having strain gauges mounted on the pin connecting the luffing piston rod to the crane boom.

FR No. 2144815: SHINOHARA ET AL/TADANO IRONWORKS COMPANY LIMITED Similar to U.S. Pat. No. 4039084 having the same application. (See Below)

U.S. Pat. No. 4216868 (=EP 8210): S. GEPPERT, AUG. 12, 1980, EATON CORPORATION Discloses a crane operating aid having absolute encoding digital optical sensors which monitor the angular displacement between the turret and its base, the luffing angle and the boom length. In the section Background of the Invention it is indicated that among uses, the digital optical sensors are envisaged being used in a load moment determining unit for a crane crane operating aid.

U.S. Pat. No. 4185280 (=DE 2659755): W. WILHELM, Jan. 22, 1980, KRUGER AND COMPANY K.G. Discloses a method of and apparatus for controlling the operation of a luffing crane. Sensors are used to determine various crane parameters, i.e., boom length, luffing angle, slewing angle and intrinsic load moment of the boom. The total load moment is compared with a maximum value, calculated from predetermined and measured parameters, and a warning signal produced when the load moment approaches its maximum permitted value for the current crane configuration.

U.S. Pat. No.4039084 (=U.S. Pat. No. 4058178) (=GB No.1402603) (=GB No. 1402602) (=FR No. 2224659) (=DE No.2265332) (=DE No. 2265318): SHINOHARA ET AL/TADANO IRONWORKS COMPANY LIMITED Discloses a safety system for cranes having extensible luffing booms. Sensors produce signals representative of the boom length and its luffing angle, from these is calculated a signal representative of the operating radius. This signal is used to derive the maximum permitted load moment for the current boom position which is compared with a current load moment signal generated by stress sensors located on the boom luffing hydraulic cylinder.

U.S. Pat. No.3870160 (=GB No.1358871): B.D.F. HUTCHINGS/PYE LIMITED Discloses a crane safe load indicator wherein the current load moment of the crane is determined and compared with a maximum permissible load moment.

U.S. Pat. No. 3771667: J.M. BECKER ET AL Discloses a moment monitoring system wherein a pressure transducer responsive to the fluid pressure in the luffing piston produces a signal representative of the load moment which is used to warn the operator of approaching instability and to activate a shut-off mechanism as the load moment approaches its maximum safe value.

It is an object of the invention to provide a method and apparatus for monitoring and displaying the effective load moment in a crane and for providing at least a warning signal when the calculated load moment approaches a preset maximum permissible load moment.

SUMMARY OF THE INVENTION

According to the invention there is provided a method of monitoring the effective load carried by a crane having a luffing boom of variable effective radius, the method comprising generating a first signal corresponding to the magnitude of a load supported by the boom, generating a second signal corresponding to the effective boom radius, performing a calculation on the signals to calculate a load moment value, displaying the calculated load moment value, comparing the calculated load moment value with a predetermined maximum permissible load moment value, and generating a warning signal if the calculated load moment value differs from the maximum load moment value by less than a predetermined amount, the effective boom radius being determined from a predetermined relationship between the luffing angle of the boom and the first signal.

Further according to the invention there is provided apparatus for monitoring the effective load carried by a crane having a luffing boom of variable effective radius which comprises means for generating a first signal corresponding to the magnitude of a load supported by the boom, means for generating a second signal corresponding to the effective boom radius from a predetermined relationship between the luffing angle of the boom and the first signal, processing means for performing a calculation on the signals to derive a load moment value, display means for displaying the load a moment value, memory means for storing a predetermined maximum permissible load moment value, comparator means for comparing the calculated load moment value with the predetermined maximum permissible load moment value, and means for generating a warning signal if the calculated load moment value differs from the maximum permissible load moment value by less than the predetermined amount.

The boom may be raised and lowered by means of a hydraulic ram, the first signal being generated by a pressure sensor associated with the ram.

Alternatively the boom may be raised and lowered by means of a cable connected between the boom and a winch, the first signal being generated by a pressure sensor associated with a hydraulic tensioner which is arranged to be deflected by tension in the cable.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DETAILED DESCRIPTION

Figure 1:
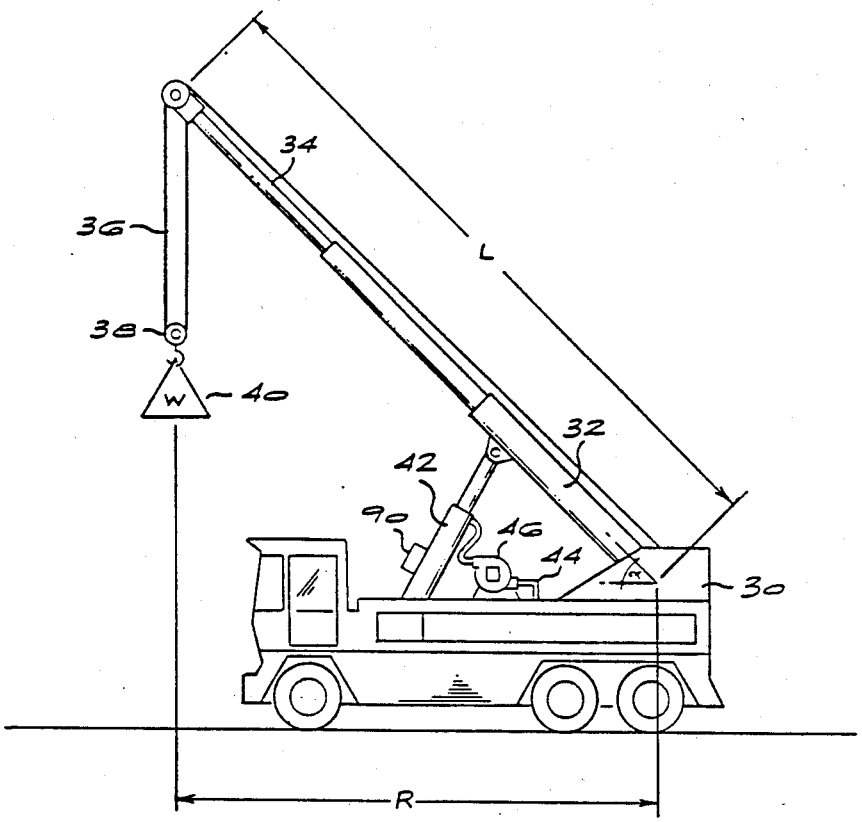
FIG. 1 is a schematic illustration of a hydraulic crane, illustrating the application of the invention thereto.

In FIG. 1, a hydraulic crane is illustrated schematically. The crane has a mobile base 30 to which is pivoted a boom 32 having an extendible portion 34. A cable 36 is supported at the end of the extendible portion 34 and carries a block 38 which supports a load 40. A hydraulic ram 42 which is supplied with hydraulic fluid under pressure via a hydraulic line 44 raises or lowers (luffs) the boom, which can also slew. A flow rate sensor 46 is located in the hydraulic line 44 to the ram 42. The effective boom radius R of the crane can be seen to be a function both of the boom angle and of the boom length L. If the boom angle is $\alpha$, then the effective boom radius $R = L\cos\alpha$. The load moment of the crane is equal to WR, when W is the mass of the load 40.

It can be seen that a load which can be safely carried with the boom at a particular length and angle may become unsafe if the boom angle is decreased or the boom extended. Because of the relatively complex interaction between the variables concerned, it is very difficult for a crane operator to assess the position instantaneously, and an automated crane load monitoring system becomes highly desirable.

FIGS. 3 to 6 show the layout of such load monitoring apparatus according to the invention, in electrical schematic form. It will be understood that the illustrated apparatus is adapted for use with a luffing crane having a telescopic boom such as that illustrated in FIG. 1, but can be adapted and/or simplified for use with other cranes, including those with non-luffing booms or non-telescoping booms having a fixed length.

The method of calculating the load moment of the crane according to the invention does not require a boom length sensor. The hydraulic ram 42 which raises and lowers the boom 32 is fitted with a hydraulic pressure sensor 90 which measures the pressure of the hydraulic fluid in the ram 42 and provides an electrical signal which is used to calculated the weight lifted. The sensor 90 produces a signal which is proportional to the pressure required to support the boom 32 and the load 40. Since the load moment (for a constant boom length) is also proportional to this value, the ratio of the transducer signal and the load moment value will be constant, for a constant boom length and a constant load, for any boom angle.

The fact that a separate sensor is not required to measure the boom length L reduces the cost and improves the reliability of the apparatus.

The relationship between the boom length L, the weight lifted W, the effective boom radius R, the boom angle $\alpha$, and the output signal X of the pressure sensor 90 is set out below:

$$\begin{aligned} \text{Load moment} &= WR \\ &= WL\cos\alpha \end{aligned}$$

The ratio of the output pressure signal X and the corresponding load moment value is a constant for any luffing angle $\alpha$.

Thus: ratio of load moment to output pressure signal $$\frac{WL\cos\alpha}{X} = K$$

Therefore the boom length $$L = \frac{KX}{W\cos\alpha}$$

In order to accomodate a change in the length of the boom, a switch is operated in conjunction with a boom extension/retraction control by the crane operator. This signals to a microprocessor-based control circuit that a change in the length of the boom will occur. The microprocessor stores the initial load value and pressure sensor output (W and X) values for future reference and for determination of the new boom length when the switch is released. After the boom movement has been completed, the pressure sensor 90 will provide a signal proportional to the new pressure required to support the boom and the load. Thus, assuming that the load W remains constant, the change in boom length $$\Delta L = \frac{K\Delta X}{S\cos\alpha}$$

can be calculated for the new output value of the pressure sensor 90 and the calculated boom angle. The final boom length $L+\Delta L$ can thus be determined.

Figure 2:
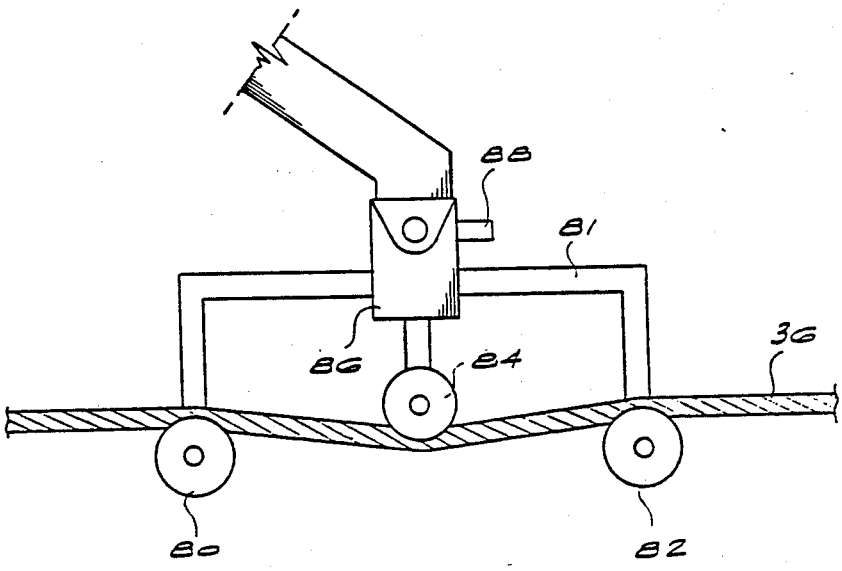
FIG. 2 is a schematic illustration of a cable load sensor.

An alternative apparatus for determining the magnitude of the load lifted by the crane is illustrated in FIG. 2. The device comprises a frame 81 which holds the hoist cable between three wheels 80, 82 and 84. The wheel 84 bears on the cable 36 on the opposite side of the cable from the wheels 80 and 82, and is connected to a hydraulic tensioner 86. As the cable is tensioned under load, it forces the wheel 84 inwards, altering the hydraulic pressure in the tensioner 86. A pressure transducer 88 provides a signal corresponding to the change in pressure, which is proportional to the magnitude of the load lifted by the crane. This signal can be used in the same way as the signal from the ram 42 in the first-described embodiment.

Figure 3:
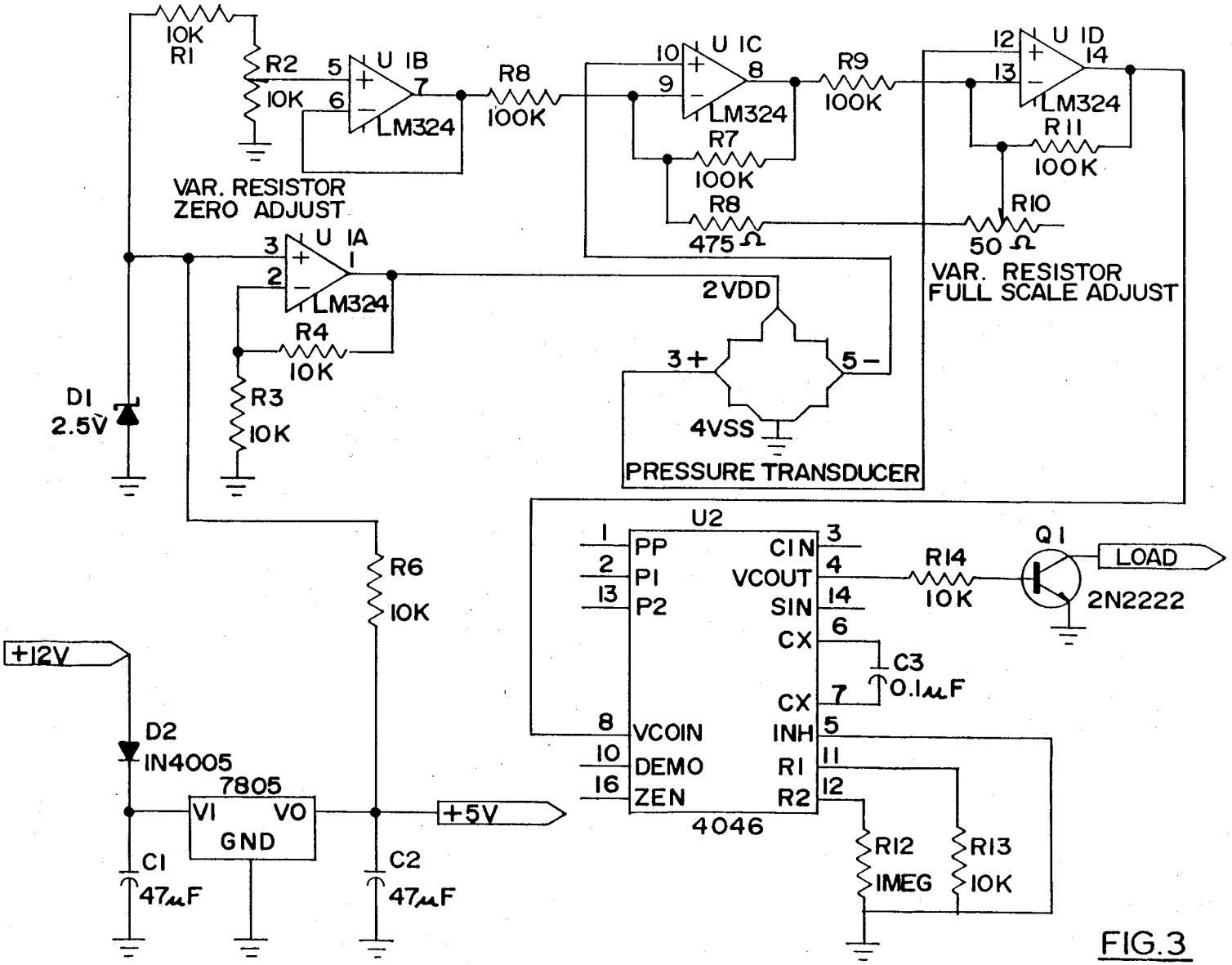
FIGS. 3 to 6 are block schematic diagrams of apparatus for monitoring the effective load carried by the crane. In the drawings like characters of reference indicate corresponding parts in the different figures.

FIG. 3 illustrates electronic circuitry for processing output of the pressure transducer 90 (or the pressure transducer 88). The pressure transducer forms part of a resistance bridge. A reference voltage is derived from a zener diode D1 and is buffered by an amplifier U1*a*, which supplies a constant reference voltage to the bridge. Changes in the pressure in the ram 42 (or the tensioner 86) causes the resistance of the pressure transducer to alter, unbalancing the bridge and giving rise to an output signal. This output signal is amplified by a high input impedance, adjustable-gain differential amplifier which comprises two operational amplifiers U1*c* and U1*d*. The differential amplifier has an adjustable offset potentiometer R10 which allows the full scale range of the circuit to be adjusted. The variable voltage output signal from the differential amplifier is applied to the control voltage input terminal of a voltage controlled oscillator (VCO) U2. The output of the VCO is therefore an AC waveform having a frequency which varies proportionally with the load supported by the crane. The VCO output is buffered by a transistor Q1.

The boom angle $\alpha$ can be determined in a number of ways. In an embodiment suitable for use with the crane of FIG. 1, the flow rate sensor 46 is arranged to provide signals whenever hydraulic fluid is pumped into or out of the ram 42 to raise or lower the boom 32. The flow rate signal is processed, as described below, and effectively provides a signal which corresponds to a change in the boom angle. These changes are compared to an initial boom angle which has been calibrated into the system.

An alternative method of calculating the boom angle employs a rotary encoder which is mounted at or near the pivot of the boom and is connected to the boom so that the encoder rotates in a direction related to the luffing movement of the boom. Such an encoder can be used both with the type of crane illustrated in FIG. 1, or with cranes which employ a cable to raise and lower the boom. Such encoders are well-known per se in similar applications.

Figure 4:
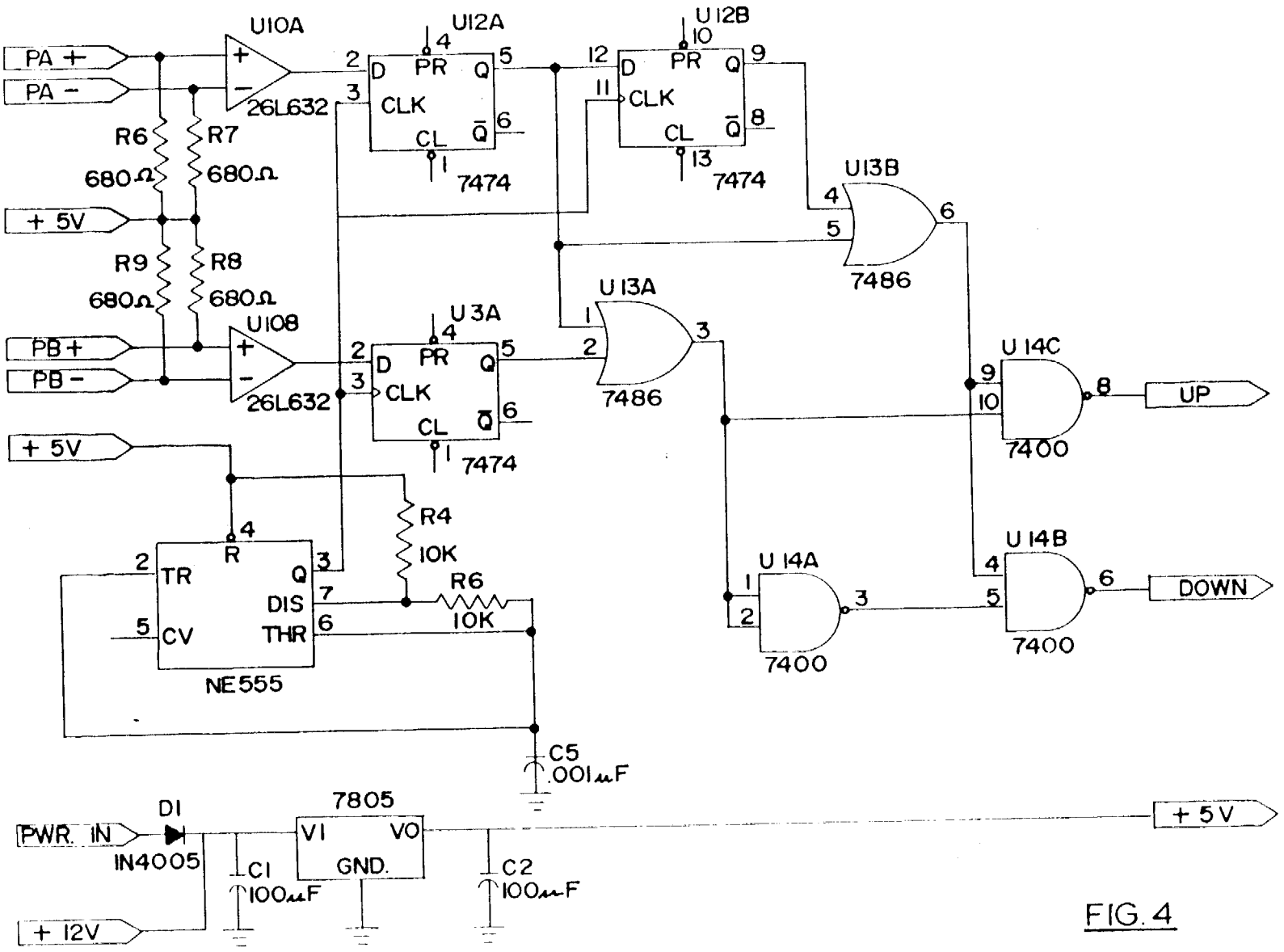

The circuit illustrated in FIG. 4 is intended particularly for use with a rotary encoder of the kind described above. It will, however, be appreciated that a similar circuit could be used to process the output of a flow rate sensor in order to provide signals corresponding to changes in the boom angle.

The rotary encoder provides two out-of-phase signals which are fed to a pair of differential input line receivers U10*a* and U10*b*. The signals are amplified and voltage converted and are fed to the inputs of two D flip-flops U12*a* and U3*a* to provide a slight delay. The output of the flipflop U12*a* is further delayed by a third flipflop U12*b*. All three flipflops are clocked by a freerunning oscillator comprising a 555-type timer U11, with associated timing resistors and capacitor. The three output signals from the flipflops are exclusive-OR'ed by a pair of exclusive-OR gates U13*a* and U13*b*. The outputs of the exclusive-OR gates are NAND'ed as shown, using three NAND gates U14*a*, U14*b* and U14*c* to provide an UP and a DOWN outputs. The UP and the DOWN output provide output pulses when the boom is raised or lowered, respectively.

It will be understood by those skilled in the art that a similar circuit to that illustrated in FIG. 4 can be provided to process the output of the flow rate sensor 46, to provide similar UP and DOWN output pulses when the boom is raised or lowered.

Figure 5:
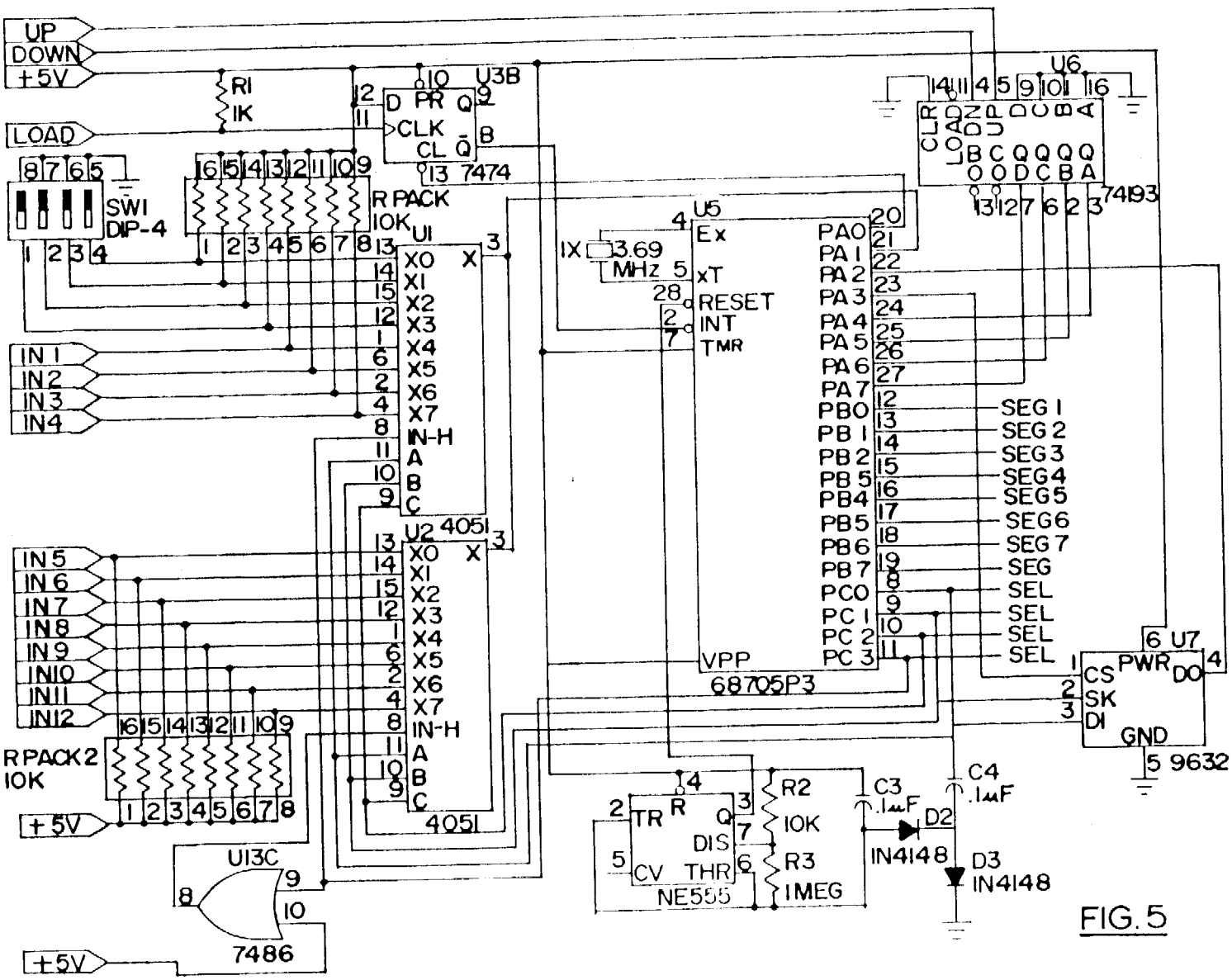
Figure 6:
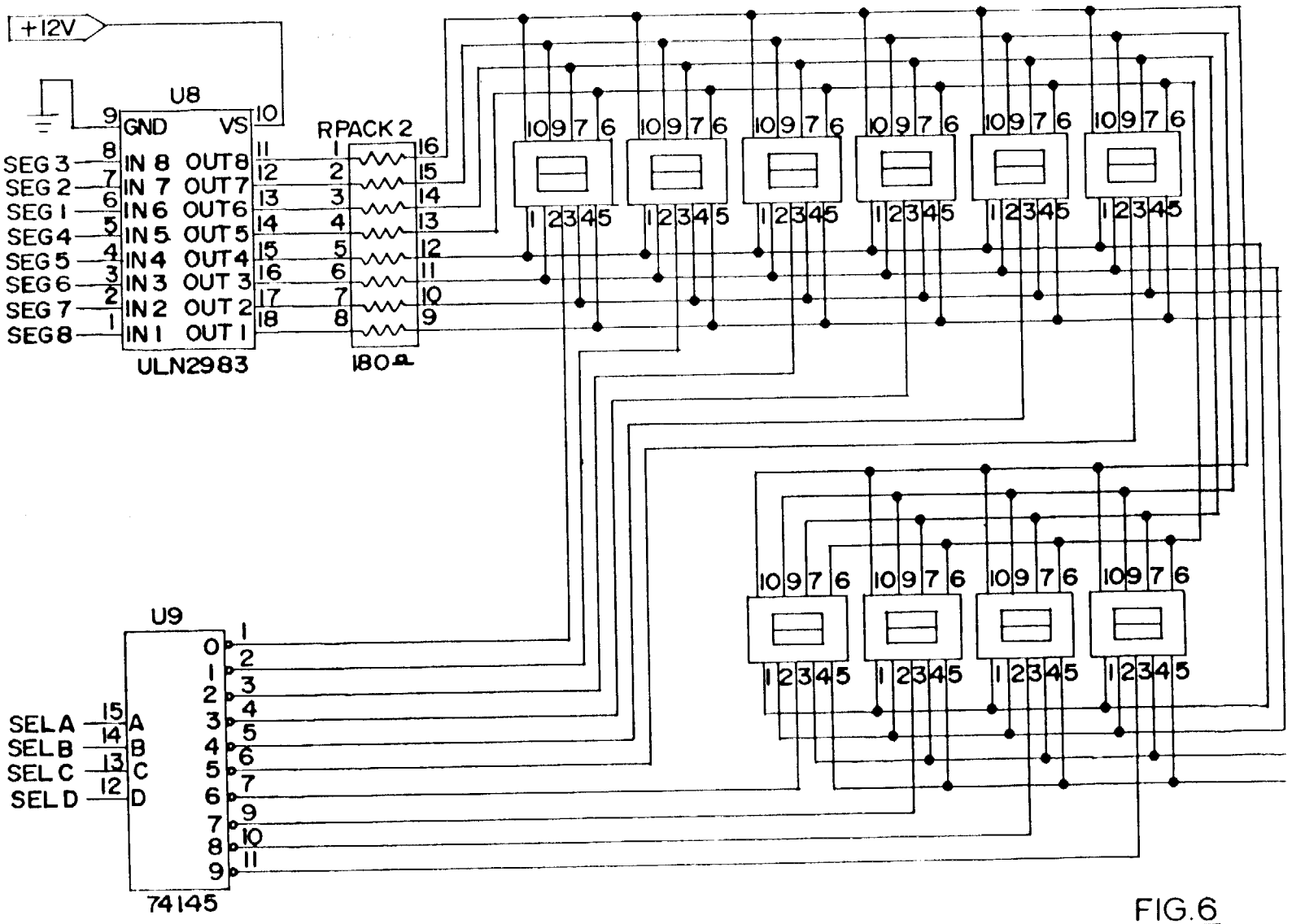

FIG. 5 illustrates a microprocessor-based control circuit which processes the outputs of the circuits in FIGS. 3 and 4 and which provides output signals for the display circuit shown in FIG. 6. The microprocessor U5 used in the prototype circuit was a Motorola (Trademark) type 68705P3. Two 8-to-1 data selectors U1 and U2 are provided, which have a total of 16 inputs. Pull-up resistors are provided on each input. Four of the inputs are connected to a DIP switch SW1 to provide user-selective options. Four signals which are also used to drive the BCD driver in the display circuitry are used, with one signal inverted, to drive the data selectors. The 16 inputs of the data selectors are sequentially scanned and read through one bit of an input port of the microprocessor under software control.

The "up" and "down" signals from the decoder circuit of FIG. 4 clock a synchronous 4 bit up-down counter U6. The output of this counter is read by four bits of the input port.

The variable frequency from the transducer circuit of FIG. 3 is used to clock a latch-connected D flipflop U3*b* which provides an interrupt input to the microprocessor. The latch is enabled or disabled under software control by an output bit of the microprocessor port.

An electrically erasable programmable read only memory (EEPROM) U7 is provided, which is used to store calibration values of the apparatus which would otherwise be lost on switching the apparatus off. Two of the four signals used to drive the BCD display driver and the multiplexed input are used in conjunction with an output bit and an input bit of the microprocessor port to select and clock the EEPROM, which operates serially.

A 555-type timer U4 is provided and is connected as a missing pulse detector. This device monitors the BCD display line. If the microprocessor stops for a predetermined length of time, a reset pulse is generated, restarting the microprocessor.

FIG. 6 illustrates the display circuitry of the apparatus, which comprises a 10-digit multiplexed 7-segment LED display. An 8-output power driver U8 supplies power to the display segments and the decimal point of the selected digit of the display, through current limiting resistors. The power driver receives 8 input signals, which correspond to the 8 bits of the microprocessor port PB. The digit displayed is selected by an BCD-to-decimal driver U9, which is controlled by outputs of port PC of the microprocessor.

The control circuit of FIG. 5 is arranged to perform a calculation, under software control, on the load signal and the boom angle signal and to calculate the effective load moment of the crane in operation. The calculated load moment value is compared with values stored in memory, and a warning signal is generated if the calculated load moment differs from the stored maximum permissible value by less than a predetermined amount (typically 5%). The display circuit indicates the actual load being carried by the crane, the effective radius of the crane, and a value calculated to be the maximum allowable load for the present effective radius of the crane.

If the crane operator ignores the warning signal, which can be visible or audible, a STOP signal is generated which prevents the crane from being operated in a direction which will increase the load moment beyond the present maximum permissible value. When this occurs, a warning light is illuminated and operation of the crane is interrupted. The operator may reduce the load moment, but may not increase it. Thus, the crane operator is fully informed at all times of how close he is to the maximum load moment of the crane, and is prevented from exceeding a safe limit.

A useful application for the load monitoring apparatus arises in situations wherein the net amount of material lifted by the crane needs to be recorded.

For example, during concrete placing on large building projects, cranes are used to transport the concrete from supply trucks to the pouring location. The site contractor has only the concrete supply company's delivery slip for a record of the concrete supplied. In order to verify the actual amount of concrete received, the net load can be calculated by the load monitoring apparatus for each lift made by the crane and the total received from each supply truck can be computed. The time at which the supply truck delivered the concrete can be determined by the load monitoring apparatus via an internal calendar/clock circuit and the combined date and time along with the total net load received from each truck can be subsequently printed for comparison with the supply truck delivery slip. This will enable the contractor to identify any delivery shortage.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A method of monitoring the effective load carried by a crane having a luffing boom of variable effective radius, the method comprising generating a first signal corresponding to the magnitude of a load supported by the boom, generating a second signal corresponding to the effective boom radius, performing a calculation on the signals to calculate a load moment value, displaying the calculated load moment value, comparing the calculated load moment value with a predetermined maximum permissible load moment value, and generating a warning signal if the calculated load moment value exceeds said predetermined maximum permissible load moment value, the, effective boom radius being determined from a predetermined relationship between the luffing angle of the boom and the first signal, said boom being raised and lowered by means of a hydraulic ram, the luffing angle of the boom being measured by monitoring the displacement of hydraulic fluid in the ram as the boom is raised or lowered to a reference angle.

2. A method according to claim 1 wherein said first signal is generated by a pressure sensor associated with said ram.

3. A method according to claim 2 wherein a rotary encoder is provided which is responsive to changes in the luffing angle of the boom and which provides output pulses which are counted to measure changes in the luffing angle of the boom relative to a reference angle.

4. A method according to claim 2 wherein the effective length L of the boom is determined from the relationship $$L = \frac{KX}{W \cos\alpha}$$

where K is a constant, W is the magnitude of the load supported by the boom, $\alpha$ is the luffing angle of the boom, and X is the first signal corresponding to the magnitude of the load supported by boom.

5. A method according to claim 4 wherein a rotary encoder is provided which is responsive to changes in the luffing angle of the boom and which provides output pulses which are counted to measure changes in the luffing angle of the boom relative to a reference angle.

6. A method according to claim 1 wherein a rotary encoder is provided which is responsive to changes in the luffing angle of the boom and which provides output pulses which are counted to measure changes in the luffing angle of the boom relative to a reference angle.

7. A method according to claim 1 wherein the effective length L of the boom is determined from the relationship $$L = \frac{KX}{W \cos\alpha}$$

where K is a constant, W is the magnitude of the load supported by the boom, $\alpha$ is the luffing angle of the boom, and X is the first signal corresponding to the magnitude of the load supported by the boom.

8. A method according to claim 7 wherein a rotary encoder is provided which is responsive to changes in the luffing angle of the boom and which provides output pulses which are counted to measure changes in the luffing angle of the boom relative to a reference angle.

9. Apparatus for monitoring the effective load carried by a crane having a luffing boom of variable effective radius which comprises means for generating a first signal corresponding to the magnitude of a load supported by the boom, means for generating a second signal corresponding to the effective boom radius from a predetermined relationship between the luffing angle of the boom and the first signal, processing means for performing a calculation on the signals to derive a load moment value, display means for displaying the load moment value, memory means for storing a predetermined maximum permissible load moment value, comparator means for comparing the calculated load moment value with the predetermined maximum permissible load moment value, and means for generating a warning signal if the calculated load moment value exceeds said predetermined maximum permissible load moment value, said boom being raised and lowered by means of a hydraulic ram, the luffing angle of the boom being measured by monitoring the displacement of hydraulic fluid in the ram as the boom is raised or lowered relative to a reference angle.

10. Apparatus according to claim 9 wherein said first signal is generated by a pressure sensor associated with said ram.

11. Apparatus according to claim 10 wherein a rotary encoder is provided which is responsive to changes in the luffing angle of the boom and which provides output pulses which are counted to measure changes in the luffing angle of the boom relative to a reference angle.

12. Apparatus according to claim 10 wherein the processing means is adapted to determine the effective length L of the boom from the relationship $$L = \frac{KX}{W \cos\alpha}$$

where K is a constant, W is the magnitude of the load supported by the boom, $\alpha$ is the luffing angle of the boom, and X is the first signal corresponding to the magnitude of the load supported by the boom.

13. Apparatus according to claim 12 wherein a rotary encoder is provided which is responsive to changes in the luffing angle of the boom and which provides output pulses which are counted to measure changes in the luffing angle of the boom relative to a reference angle.

14. Apparatus according to claim 9 wherein a rotary encoder is provided which is responsive to changes in the luffing angle of the boom and which provides output pulses which are counted to measure changes in the luffing angle of the boom relative to a reference angle.

15. Apparatus according to claim 9 wherein the processing means is adapted to determine the effective length L of the boom from the relationship $$L = \frac{KX}{W \cos\alpha}$$

where K is a constant, W is the magnitude of the load supported by the boom, $\alpha$ is the luffing angle of the boom, and X is the first signal corresponding to the magnitude of the load supported by the boom.

* * * * *

UNITED STATES PATENT AND TRADEMARK OFFICE

CERTIFICATE OF CORRECTION

PATENT NO. : 4,906,981

DATED : March 6, 1990

INVENTOR(S) : BARRY J. NIELD

It is certified that error appears in the above-identified patent and that said Letters Patent is hereby corrected as shown below:

The sheets of drawings consisting of FIGS. 4 to 6, should be added as shown on the attached sheets.

Signed and Sealed this

Twenty-eighth Day of May, 1991

*Attest:*

HARRY F. MANBECK, JR.

*Attesting Officer*

*Commissioner of Patents and Trademarks*